US009517860B2

(12) United States Patent
Seymour

(10) Patent No.: US 9,517,860 B2
(45) Date of Patent: Dec. 13, 2016

(54) PAINT CONTAINER HANDLING SYSTEM

(71) Applicant: Scott Allen Seymour, Tampa, FL (US)

(72) Inventor: Scott Allen Seymour, Tampa, FL (US)

( * ) Notice: Subject to any disclaimer, the term of this patent is extended or adjusted under 35 U.S.C. 154(b) by 0 days.

(21) Appl. No.: 14/632,045

(22) Filed: Feb. 26, 2015

(65) Prior Publication Data

US 2016/0251118 A1 Sep. 1, 2016

(51) Int. Cl.
*B65D 25/32* (2006.01)
*B44D 3/12* (2006.01)

(52) U.S. Cl.
CPC ..... *B65D 25/32* (2013.01); *B44D 3/12* (2013.01)

(58) Field of Classification Search
CPC ..... B44D 3/14; B44D 3/12; B65D 25/32; B65D 25/28; B65D 25/287; B65D 25/2873; B25G 1/10; B25G 1/102
USPC ..... 220/760, 755, 752, 756, 754, 759, 758,220/696, 699, 700, 701, 736; 16/425, 422, 430, 16/110.1; 248/318, 211, 210; D32/54, 53
See application file for complete search history.

(56) References Cited

U.S. PATENT DOCUMENTS 2,493,751 A * 1/1950 Davis ..... B44D 3/123 131/257
4,053,131 A * 10/1977 Francis ..... E06C 7/14 248/210
D313,296 S * 12/1990 Abbey ..... 248/211
D313,490 S * 1/1991 Abbey ..... 248/211
4,993,767 A * 2/1991 Song ..... A47J 45/10 220/736
5,584,520 A * 12/1996 Niemeier ..... E06C 7/14 220/759
5,806,709 A * 9/1998 Marshall, II ..... B44D 3/14 220/755
D456,578 S * 4/2002 Smith ..... D32/54
7,387,323 B1 * 6/2008 Minnette ..... B44D 3/14 220/756
8,863,981 B1 * 10/2014 Fontaine ..... B65D 25/28 220/755

* cited by examiner

*Primary Examiner* — Robert J Hicks
(74) *Attorney, Agent, or Firm* — Sandra L. Layer

(57) ABSTRACT

A paint container handling system comprised of an ergonomic gripping handle formed with an upper slot for retaining the wire handle of a paint can and formed with a lower slot designed to couple the handle to the rim of a paint container. An optional strap provides an additional coupling mechanism.

11 Claims, 4 Drawing Sheets

FIG. 1
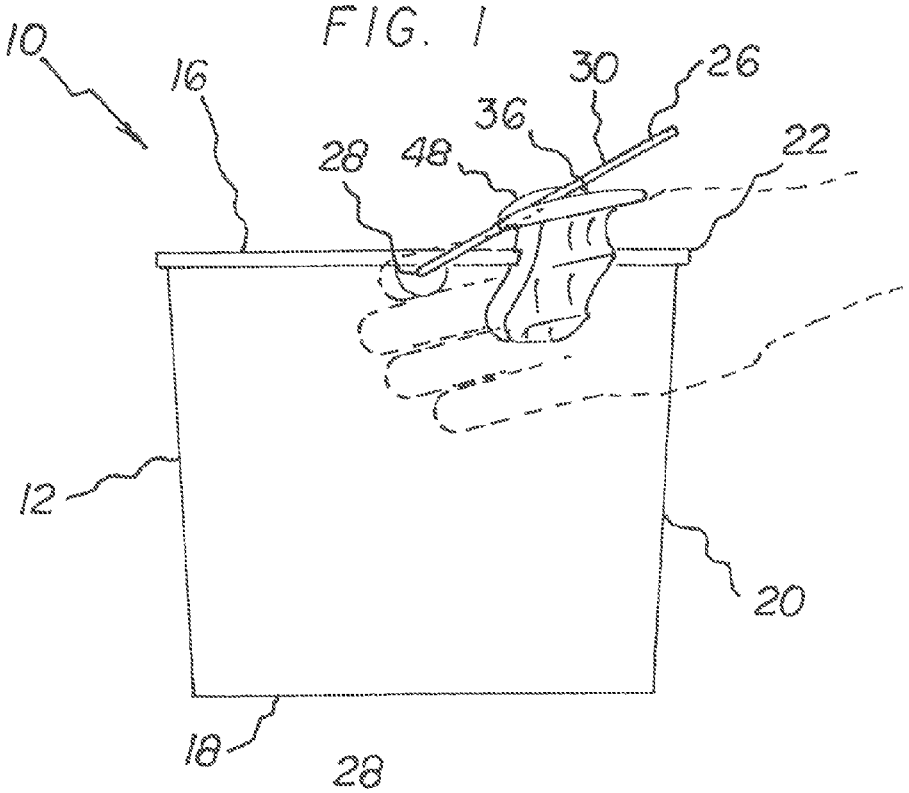
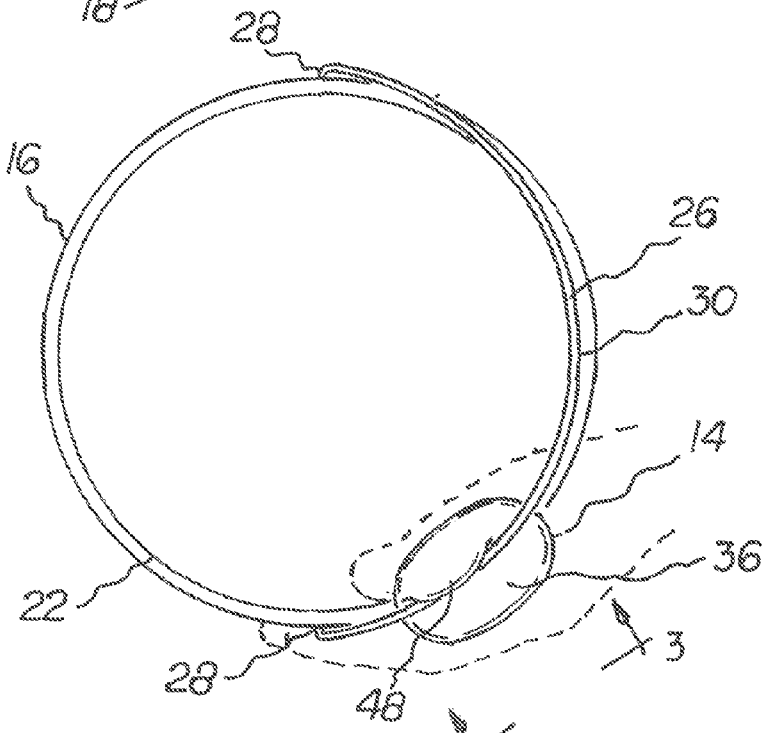
FIG. 2

FIG. 3
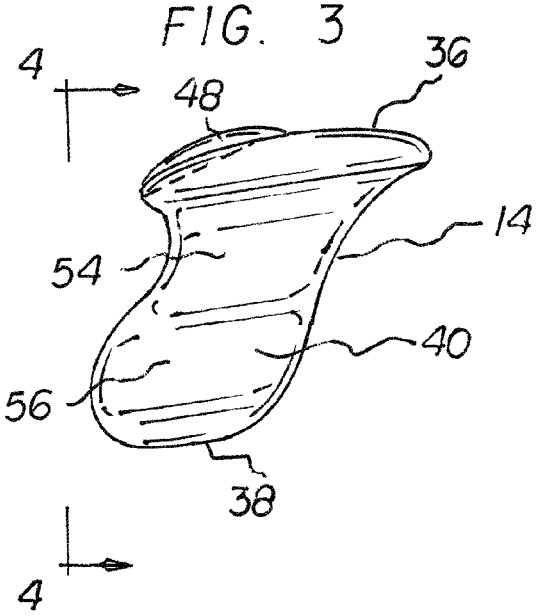
FIG. 4
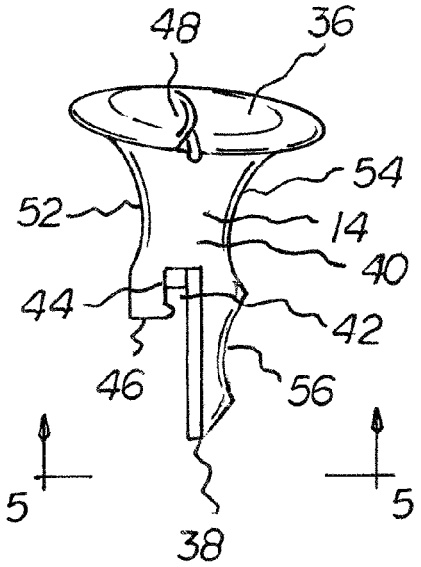
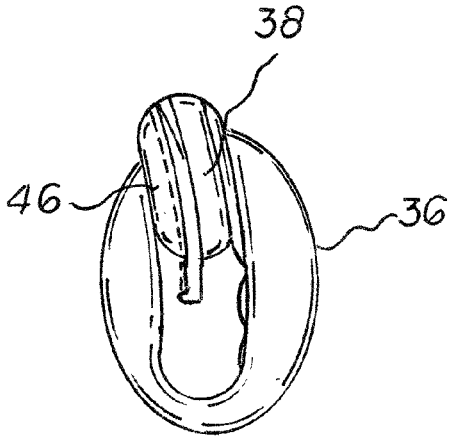
FIG. 5

FIG. 8
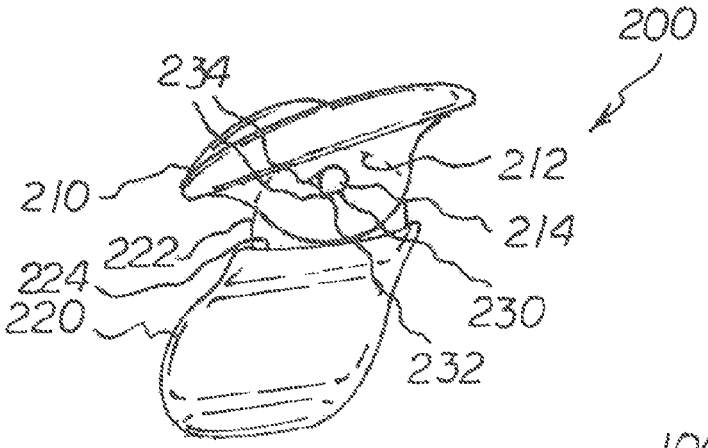
FIG. 7
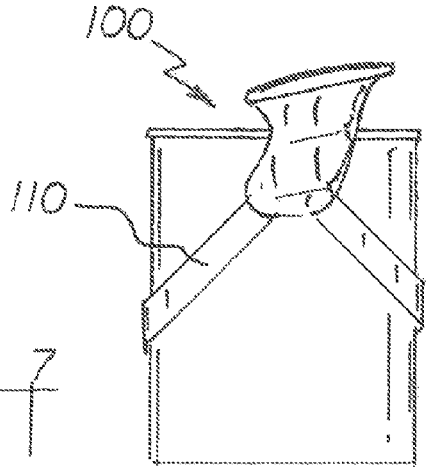
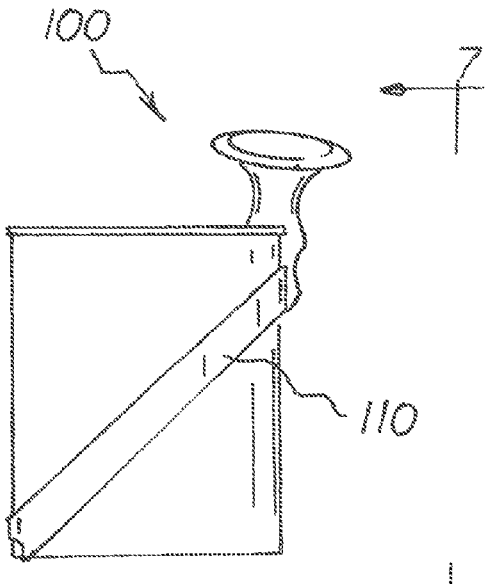
FIG. 6

PAINT CONTAINER HANDLING SYSTEM

BACKGROUND OF THE INVENTION

Field of the Invention

The present invention relates to a paint container handling system and more particularly pertains to an ergonomic handle for use with a paint can.

Description of the Prior Art

The use of paint can handles is known in the prior art. Many painters prefer to paint directly from the can and are faced with the problem of holding the paint can with one hand in a manner such that the can is stable and the handle is prevented from blocking access to the opening of the can while allowing the painter to the paint freely with their other hand. More specifically, paint can handles previously devised and utilized for the purpose of assisting the painter in holding the can are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,806,709 to Marshall discloses a Handle for Use with Paint Can. U.S. Pat. No. 7,387,323 to Minnette and Julian discloses a Carrier for Paint Can or Other Container Having a Bail. U.S. Pat. No. 2,493,751 to Davis discloses a Combination Brush Holder and Paint Can Handle. Lastly, U.S. Pat. No. 4,993,767 to Song discloses a Detachable Handle for Containers.

While these devices fulfill their respective, particular objectives and requirements, the aforementioned patents do not describe paint container handling system that allows an ergonomic handle for use with a paint can.

In this respect, the paint container handling system according to the present invention substantially departs from the conventional concepts and designs of the prior art, and in doing so provides an apparatus primarily developed for the purpose of an ergonomic handle for use with a paint can.

Therefore, it can be appreciated that there exists a continuing need for a new and improved paint container handling system which can be used for an ergonomic handle for use with a paint can. In this regard, the present invention substantially fulfills this need.

SUMMARY OF THE INVENTION

In view of the foregoing disadvantages inherent in the known types of paint can handles now present in the prior art, the present invention provides an improved paint container handling system. As such, the general purpose of the present invention, which will be described subsequently in greater detail, is to provide a new and improved paint container handling system and method which has all the advantages of the prior art and none of the disadvantages.

To attain this, the present invention essentially comprises a gripping device formed with an upper surface, a lower surface and a side surface. A slot is formed in the lower surface in an arcuate configuration with a radius of curvature equal to the radius of curvature of the upper edge of a paint container including paint cans, buckets and cut pots. An upper ledge positionable upon the upper edge of a paint container is formed in the upper edge of the lower slot. The gripping device has an upper portion extending above the upper ledge and above the container and a lower portion extending below the upper ledge. The gripper device has an interior extent radially interior of the container and an exterior extent radially exterior of the can.

Another feature of the present invention includes an inner groove formed in the interior surface above the ledge for receiving a thumb of the painter, and at least two outer grooves formed in the exterior surface for receiving fingers of the painter. The outer grooves include one upper groove above the ledge and at least one lower groove below the ledge.

A feature of the present invention is an upper slot which extends downwardly from the upper surface of the gripping device. The upper slot is arcuate with a radius of curvature equal to the radius of curvature of a wire handle of a paint can for removably receiving the handle of the paint can.

Still another feature of the present invention is a strap that couples the gripping handle to a paint can for use with a paint bucket or can without a wire handle.

The invention also includes a system constructed in accordance with an alternate embodiment of the invention wherein the upper and lower extents of the invention are formed separately and connected by a pressure hinge. The pressure hinge connects the upper portion and the lower portion, allowing the upper portion to rotate with respect to the lower portion thus eliminating stress on a painter's wrist when operating the device at a lower elevation. Another feature includes a positional clocking mechanism which prohibits the hinge from rotating freely, locking the upper and lower extents into one of two or more positions.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint container handling system which has all of the advantages of the prior art paint can handles and none of the disadvantages.

It is another object of the present invention to provide a new and improved paint container handling system which may be easily and efficiently manufactured and marketed.

It is further object of the present invention to provide a new and improved paint container handling system which is of durable and reliable constructions.

An even further object of the present invention is to provide a new and improved paint container handling system which is susceptible of a low cost of manufacture with regard to both materials and labor, and which accordingly is then susceptible of low prices of sale to the consuming public, thereby making such paint container handling system economically available to the buying public.

Another object of the present invention is to provide a paint container handling system that allows for single handed support and manipulation of the paint container when painting, keeping the second hand free to paint.

Even still another object of the present invention is to provide a paint container handling system having an ergonomic handle for use with a paint can.

Still another object of the present invention is to provide a paint container handling system that alleviates wrist and hand fatigue.

Still another object of the present invention is to provide a system that is easily transferable from one paint can to another.

Another object of the present invention is to leverage the wire handle of the paint can to provide stability and support and aiding in the manipulation of the paint container.

Lastly, it is an object of the present invention to provide a new and improved paint container handling system that prevents the wire handle from blocking the can opening.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a paint container handling system constructed in accordance with the principles of the present invention coupled to a paint can.

FIG. 2 is a top view of a paint container handling system constructed in accordance with the principles of the present invention coupled to a paint can.

FIG. 3 is a side view of a paint container handling system taken along line 3-3 of FIG. 2.

FIG. 4 is an isometric view of a paint container handling system.

FIG. 5 is a bottom view of a paint container handling system taken along line 5-5 of FIG. 4.

FIG. 6 is a perspective view of an alternate embodiment of a paint container handling system mounted on a paint container.

FIG. 7 is a side view of an alternate embodiment of a paint container handling system taken along line 8-8 of FIG. 6.

FIG. 8 is a side view of an alternate embodiment of a paint container handling system including a pressure hinge and positional locking mechanism

The same reference numerals refer to the same parts throughout the various Figures.

DESCRIPTION OF THE PREFERRED EMBODIMENT

Figure 9:
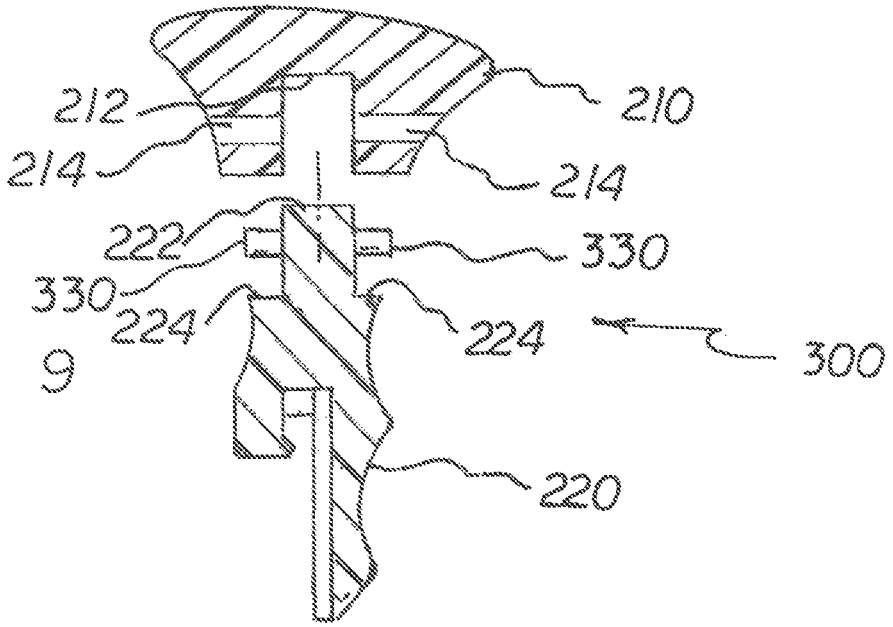
FIG. 9 is a cross section view of an alternate embodiment of a paint container handling system including a pressure hinge taken along line 9-9 of FIG. 10.

With reference now to the drawings, and in particular to FIG. 1 thereof, the preferred embodiment of the new and improved paint container handling system embodying the principles and concepts of the present invention and generally designated by the reference numeral 10 will be described.

The present invention, the paint container handling system 10 is comprised of a plurality of components. Such components in their broadest context include a gripping device having an upper extent with grooves for a thumb and index finger, a lower extent with a slot for mounting on the edge of a paint can and at least one additional finger groove, and a top slot for attaching the wire handle of a paint can. Such components are individually configured and correlated with respect to each other so as to attain the desired objective.

The preferred embodiment is designed to be coupled to a paint can 12 having a circular open top 16 and a circular closed bottom 18 and a cylindrical side wall 20 between the open top and closed bottom, a circular upper edge 22 between the open top and cylindrical side wall, the upper edge and the cylindrical side wall having a first radius of curvature, and the can being formed of a rigid material. The paint can having a handle 26 having free ends 28 pivotably coupled to the side wall of the can at diametrically spaced locations adjacent to the upper edge. The handle has an arcuate central section 30 between the free ends. The arcuate section has a second radius of curvature greater than the first radius of curvature. The handle is fabricated of a rigid metallic material.

Referring to FIGS. 1 through 5, the preferred embodiment comprises a gripping device 14 formed in a monolithic configuration. The gripping device has an upper surface 36 and a lower surface 38 and a side surface 40 between the upper surface and the lower surface. A lower slot 42 is formed in the gripping device extending upwardly from the lower surface. The lower slot has an arcuate configuration with a radius of curvature equal to the first radius of curvature. The lower slot has an upper ledge 44 positionable upon the upper edge of the can. An inwardly facing finger 46 is formed in the surface extending radially interiorly into the slot, the finger is adapted to fit in to the annular recess of the upper lip of a paint can.

The gripping device has an upper extent located elevationally above the upper ledge and above the can during use when coupled to the can. The gripping device has a lower extent located elevationally below the upper ledge during use when coupled to the can. The gripping device has an interior extent located radially interior of the can during use when coupled to the can. The gripping device has an exterior extent radially exterior of the can during use when coupled to the can. The upper extent has a primary height and the lower extent radially interior of the lower slot has a secondary height. The lower extent radially exterior of the lower slot has a tertiary height. The secondary height is less than the primary height, and the tertiary height is greater than the primary height.

An upper slot 48 extends downwardly from the upper surface of the gripping device. The upper slot is arcuate with a radius of curvature equal to the second radius of curvature for removably receiving the handle of the paint can.

An inner groove 52 is formed in the interior surface of the upper extent of the gripping device, the inner groove is formed at an acute angle with respect to horizontal for receiving a thumb of the painter. Two outer grooves 54, 56 are formed in the exterior surface, the outer grooves are at an acute angle with respect to horizontal for receiving fingers of the painter. The two outer grooves include one upper groove 54 located above the ledge and one lower groove 56 located below the ledge.

An alternate embodiment shown in FIGS. 6 and 7 includes a strap 110 attached to the lower extent of the gripping device 100 and adapted to couple the gripping device to a paint can or bucket without the aid of the wire handle.

In reference to FIG. 8 the invention also includes a system 200 constructed in accordance with an alternate embodiment of the invention wherein the upper extent is formed separately from the lower extent and connected by a pivot pin. The upper extent 210 is formed with a downwardly extending component. The lower edge of the component is formed in a convex configuration. The downwardly extending component has an upwardly extending channel 212. The top of the channel is formed in a concave configuration. Double apertures 214 in the upper extent are centrally aligned with respect to the upwardly extending channel. The lower extent 220 is formed with a central upwardly extending projection 222 and two flat shoulders 224. The upwardly extending component has a convex configuration. An axially aligned aperture is formed in the upwardly extending component 222 of the lower extent.

A pivot pin 230 extends through the double apertures in the upper extent and the axially aligned aperture of the lower extent. The pivot pin rotationally couples the upper extent to the lower extent. The upwardly extending projection of the lower extent extends into contact with the channel of the upper extent to facilitate pivoting the orientation of the upper surface with respect to the lower extent whereby the container may be held at a comfortable orientation with respect to the user.

An additional feature of the alternate embodiment includes a raised triangular shaped projection 232 which extends radially from the pivot pin and two or more triangular shaped notches 234 formed in each of the double apertures 214 in the upper extent. The triangular shaped notches correspond in size to the triangular shaped projection of the pivot pin. The pivot pin 230 extends through the double apertures in the upper extent and the axially aligned aperture of the lower extent and couples the lower extent to the upper extent with the triangular shaped projection radially aligned with one set of the triangular shaped notches of the upper extent providing a positional locking mechanism and preventing the upper and lower extent from rotating freely.

Figure 10:
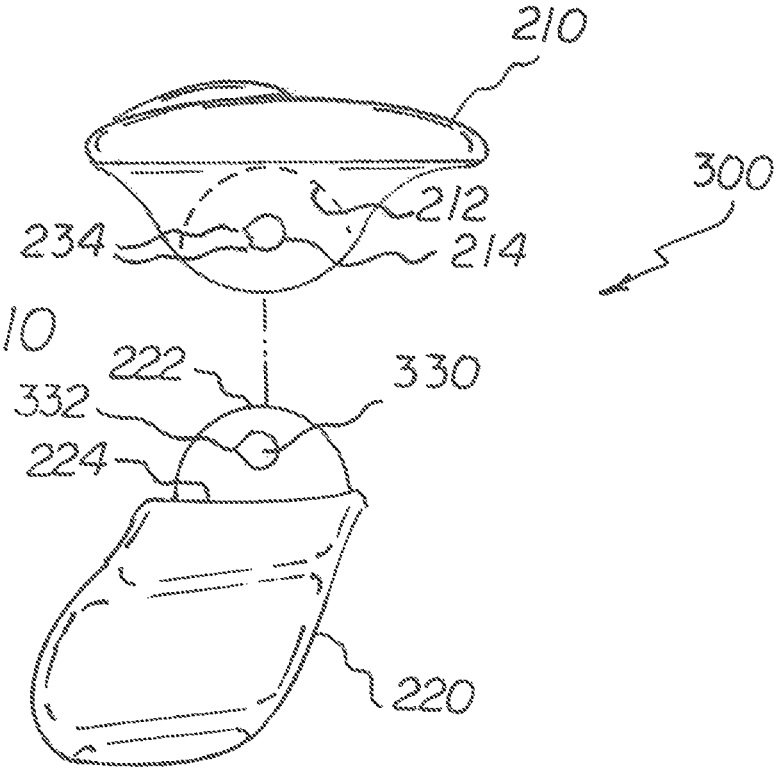
FIG. 10 is a partially exploded view of alternate embodiment including a pressure hinge and positional locking mechanism.

A further embodiment 300 is shown in FIGS. 9 and 10 wherein the lower extent is formed with a central upwardly extending project configured with two vertically aligned and outwardly projecting posts 330. A triangular shaped projection 332 extends radially from each post. At least two radially aligned triangular shaped notches 234 are cut into each of the two apertures 214 each notch corresponding in size to the triangular shaped projections 332 extending radially from each of the posts 330. The outwardly projecting posts extending through the double apertures, the triangular shaped projections radially aligned with one of the triangular shaped notches providing a positional locking mechanism and preventing the upper and lower extent from rotating freely.

Painters are often faced with the dilemma of how to hold a paint can with one hand while painting with the other hand in order to work as quickly and efficiently as possible. Many painters attempt to hold the can at the point where the wire handle attaches to the can, placing wire between their thumb and index finger allowing the weight to rest on the top of the thumb and using their fingers to hold the can steady. This configuration often leads to pain and fatigue and the wire 'bites' into the thumb of the painter. The ergonomic design of the paint container handling system will allow painters to hold and manipulate a paint can while painting. When coupled to a paint can adjacent to the handle with the handle in the upper slot the amount of strain placed on the wrist when holding and manipulating the can is lessened and the handle of the paint can is prevented from blocking access to the opening. Proper use of the device reduces the amount of torque on the wrist by positioning the center point of the wrist (the fulcrum) to the closest point to the center of gravity of the pot being held. This provides the largest amount of coverage of the possible weight bearing area of the hand in its natural position as well as adding more area of friction for lift on the fingers. Proper positioning coupled with the pulling up action from the fingers causes the torque to be spread both above and below of the fulcrum point of the wrist. When placed in the upper slot, the handle of the paint can keeps the gripping device in place providing additional leverage while keeping the handle from blocking access to the opening. When using a paint bucket or can without a wire handle, a strap is added to attach the gripping device to the can or bucket to keep the gripping device in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A container handling system comprising:

a gripping device having an upper surface and a lower surface and a side surface, a lower slot formed in the gripping device extending upwardly from the lower surface, the lower slot having an arcuate configuration with a first radius of curvature, the lower slot having an upper ledge positionable above an upper edge of a container;

the gripping device having an upper extent elevationally above the upper ledge and above the container, the gripping device having a lower extent elevationally below the upper ledge, the gripping device having an interior extent radially interior of the container during use, the gripping device having an exterior extent radially exterior of the container during use, the exterior extent being longer than the interior extent, an inner groove formed in the interior extent above the ledge, the inner groove being at an acute angle with respect to horizontal for receiving a thumb of the user at least one outer groove formed in the exterior extent, the outer groove being at an acute angle with respect to horizontal for receiving the index finger of the user.

2. The system as set forth in claim 1 and further including an upper slot extending downwardly from the upper surface of the gripping device, the upper slot being arcuate with a radius of curvature equal to the radius of curvature of a container handle for removably receiving the container handle.

3. The system as set forth in claim 2 wherein the upper ledge of the lower slot is adapted for use with a paint can having an annular recess formed in the upper edge.

4. The system as set forth in claim 1 wherein the upper edge of the lower slot is adapted for use with a paint container having an open top, the open top being cylindrical and having a singular edge.

5. The system as set forth in claim 1 wherein the upper edge of the lower slot is adapted for use with a paint bucket.

6. The system as set forth in claim 1 and further including at least two outer grooves formed in the exterior extent, the outer grooves being at an acute angle with respect to horizontal for receiving fingers of the user, the outer grooves including one upper groove above the upper ledge and at least one lower groove below the upper ledge.

7. The system as set forth in claim 1 and further including:

a strap attached to the lower extent of the gripping device and adapted to secure the gripping device to the container.

8. The system as set forth in claim 2 wherein the upper extent is formed separately from the lower extent, the system further including:

the upper extent having a downwardly extending component, the lower edge of the component formed in a convex configuration, the downwardly extending component having an upwardly extending channel, the upwardly extending channel having a concave configuration, the upper extent having double apertures centrally aligned with respect to upwardly extending channel;

the lower extent formed with a central upwardly extending projection and two flat shoulders, the upwardly extending component having a convex configuration, the lower extent projection having an axially aligned aperture; and a pivot pin extending through the double apertures in the upper extent and the central axially aligned apertures of the lower extent, the pivot pin rotationally coupling the upper extent to the lower extent, the upwardly extending projection of the lower extent extending into contact with the channel of the upper extent to facilitate pivoting the orientation of the upper surface with respect to the lower extent whereby the container may be held at a comfortable orientation with respect to the user.

9. The system as set forth in claim 8 further including a triangular shaped projection extending radially from the pivot pin, the upper extent formed with two or more triangular shaped notches formed in the double apertures, each pair of triangular shaped notches being radially aligned, the triangular shaped notches corresponding in size to the triangular shaped projection of the pivot pin, the pivot pin extending through the double apertures in the upper extent and the axially aligned aperture of the lower extent and coupling the lower extent to the upper extent with the triangular shaped projection radially aligned with one radially aligned pair of the triangular shaped notches of the upper extent providing a positional locking mechanism and preventing the upper and lower extent from rotating freely.

10. The system as set forth claim 2 wherein the upper extend is formed separately from the lower extent, the system further including:

the upper extent having a downwardly extending component, the lower edge of the component formed in a convex configuration, the downwardly extending component having an upwardly extending channel, the upwardly extending channel having a concave configuration, the upper extent having double apertures centrally aligned with respect to upwardly extending channel, the upper extent formed with two or more triangular shaped notches formed in the double apertures each pair of triangular shaped notches being radially aligned; and the lower extent formed with a central upwardly extending projection and two flat shoulders, the upwardly extending component having a convex configuration, two vertically aligned and outwardly projecting posts extend from the upper portion of the projection, a triangular shaped projection extending radially from each post, the triangular shaped projections corresponding in size to the radially aligned triangular shaped notches cut into the double apertures of the upper extent, the outwardly projecting posts extending through the double apertures, the triangular shaped projections aligned with one radially aligned pair of the triangular shaped notches providing a positional locking mechanism and preventing the upper and lower extent from rotating freely.

11. A paint container handling system for removably coupling a paint can and a gripping device for facilitating the holding of the can by a painter during use, the coupling and holding being done in a safe, ergonomic, convenient, and economical manner, the system comprising, in combination:

the paint can having a circular open top and a circular closed bottom and a cylindrical side wall between the open top and closed bottom, a circular upper edge between the open top and cylindrical side wall, the upper edge and the cylindrical side wall having a first radius of curvature, an annular recess formed in the circular upper edge, the can being formed of a rigid material;

a handle having free ends pivotably coupled to the side wall of the can at diametrically spaced locations adjacent to the upper edge, the handle having an arcuate central section between the free ends, the arcuate section having a second radius of curvature, the handle being fabricated of a rigid metallic material;

a gripping device in a monolithic configuration, the gripping device having an upper surface and a lower surface and a side surface between the upper surface and the lower surface, a lower slot formed in the gripping device extending upwardly from the lower surface, the lower slot having an arcuate configuration with a third radius of curvature equal to the first radius of curvature, the lower slot having an upper ledge, an inwardly facing finger formed in the lower surface extending radially interiorly into the lower slot, the inwardly facing finger positionable in the annular recess of the upper edge of the paint can;

the gripping device having an upper extent elevationally above the upper ledge and above the paint can during use when coupled to the paint can, the gripping device having a lower extent elevationally below the upper ledge during use when coupled to the paint can, the gripping device having an interior extent radially interior of the can during use when coupled to the paint can, the gripping device having an exterior extent radially exterior of the paint can during use when coupled to the paint can, the upper extent having a primary height, the lower extent radially interior of the lower slot having a secondary height, the lower extent radially exterior of the lower slot having a tertiary height, the tertiary height being greater than the secondary height;

an upper slot extending downwardly from the upper surface of the gripping device, the upper slot being arcuate with a fourth radius of curvature equal to the second radius of curvature for removably receiving the handle; and an inner groove formed in the interior surface of the upper extent of the gripping device, the inner groove being at an acute angle with respect to horizontal for receiving a thumb of the painter, outer grooves formed in the exterior surface, the outer grooves being at an acute angle with respect to horizontal for receiving fingers of the painter, the outer grooves including one upper groove above the ledge and at least one lower groove below the ledge.

* * * * *